US006031206A

United States Patent [19]

Ebner et al.

[11] Patent Number: 6,031,206

[45] Date of Patent: Feb. 29, 2000

[54] TOWER FURNACE FOR THE HEAT TREATMENT OF METAL STRIPS

[76] Inventors: Peter Ebner, Bergham 168; Heribert Lochner, Burgwallstrasse 19, both of A-4060 Leonding, Austria

[21] Appl. No.: 09/086,837

[22] Filed: May 29, 1998

[30] Foreign Application Priority Data

Jun. 10, 1997 [AT] Austria ..... 999/97

[51] Int. Cl.[7] ..... C21D 9/62; C21D 9/66; F27B 1/09; F27B 9/28

[52] U.S. Cl. ..... 219/390; 219/388; 266/103; 266/104; 266/108; 432/8; 432/143; 432/148; 373/119; 373/127

[58] Field of Search ..... 219/388, 390, 219/406–409; 266/103, 104, 108, 252; 373/111, 117, 119, 123, 127; 392/417; 432/8, 13, 96, 143, 146, 148, 202; 34/90, 209

[56] References Cited

U.S. PATENT DOCUMENTS

| | | | |
|---|---|---|---|
| 3,823,003 | 7/1974 | Mulcihy | 373/119 |
| 4,266,932 | 5/1981 | Shinohara | 432/202 |
| 4,299,565 | 11/1981 | Shinohara | 432/148 |
| 4,691,898 | 9/1987 | Imose | 266/103 |
| 4,760,995 | 8/1988 | Fukuda et al. | 266/103 |
| 4,836,774 | 6/1989 | Harada et al. | 432/8 |
| 5,588,828 | 12/1996 | Nagata et al. | 432/96 |
| 5,609,785 | 3/1997 | Sallinen et al. | 219/388 |

FOREIGN PATENT DOCUMENTS

| | | |
|---|---|---|
| 836893 | 1/1939 | France . |
| 55-91942 | 7/1980 | Japan . |
| 7-228926 | 8/1995 | Japan . |
| 8-260059 | 10/1996 | Japan . |

*Primary Examiner*—Joseph Pelham
*Attorney, Agent, or Firm*—Collard & Roe, P.C.

[57] ABSTRACT

A tower furnace for the heat treatment of metal strips comprises a muffle (3) extending over the entire furnace height, through which muffle passes the strip (6). At the top of the muffle (3) an insulated stopper (1) with an electric heater (2) has been inserted into the muffle (3). Below this stopper (1) a gas-heated preheating space (4) is provided in the muffle (3).

2 Claims, 1 Drawing Sheet

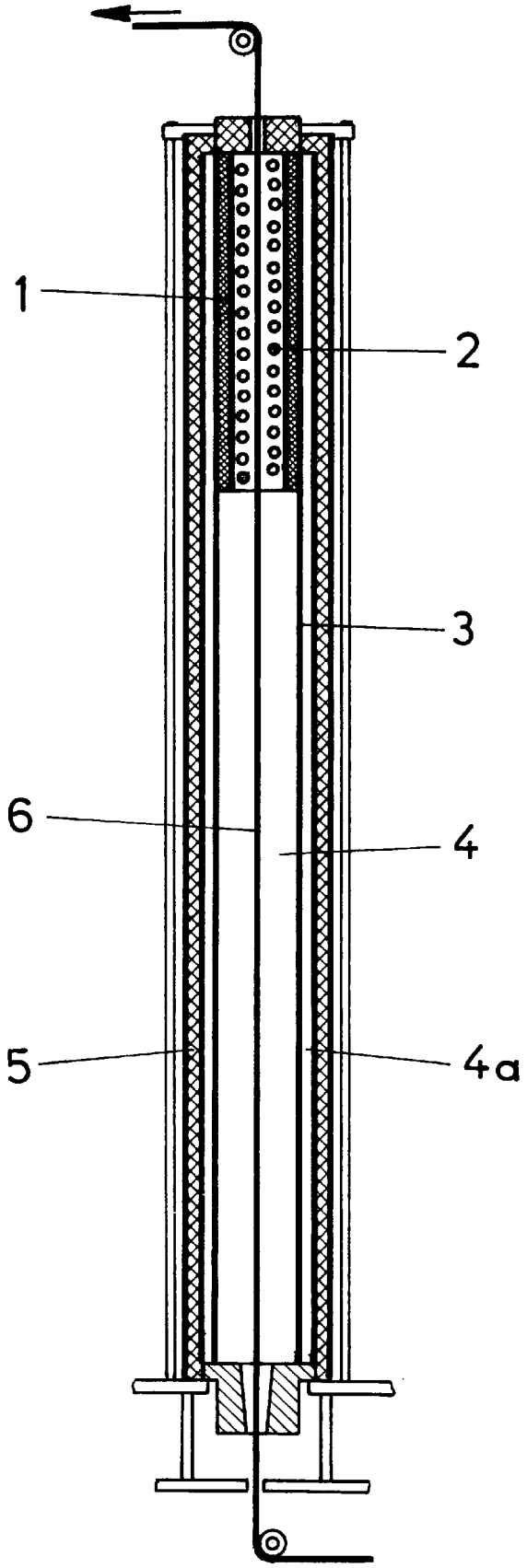
1
2
3
6
4
5
4a

TOWER FURNACE FOR THE HEAT TREATMENT OF METAL STRIPS

This invention relates to a tower furnace for the heat treatment of metal strips, comprising a muffle through which passes the strip, and which extends over the entire furnace height.

Metal strips, in particular those of Cr—Ni steel or Cr steel, have so far been continuously bright-annealed in what are called tower furnaces, where the heat treatment is effected under a protective gas, consisting of $H_2$ or a $H_2/N_2$ mixture. The strip is heated by radiation in an annealing muffle heated on the outside and is subsequently cooled in a cooling system. For heating the muffle, both gas burners and electrical resistance heating elements may be used.

Heating the strip in an electrically heated furnace without muffle is also known. However, this has the disadvantage that achieving a properly bright-annealed strip surface involves interruptions of the production and a long scavenging time with a high consumption of hydrogen during the scavenging and production process.

To achieve a maximum throughput of material, annealing is effected with the maximum possible furnace temperature. The furnace temperature is, however, limited by the material of the muffle used. The heating of the strip thus depends on the contrasting temperature of the muffle and occurs according to a function determined by the emission factors of the strip and of the muffle. The muffle length results from the breaking length of the material used, which means that the muffle's own weight can lead to its destruction.

To bring the strip temperature in the vicinity of the maximum muffle temperature, it is known to provide the furnace with a split design. In a lower, mostly gas-heated furnace provided with an annealing muffle the strip is preheated and then passes through an upper, electrically heated furnace without muffle, which may be operated at higher temperatures. Since part of the furnace is designed without muffle, there is again achieved a prolonged scavenging time. The $H_2$ operation involves higher losses of energy on the outer wall of the furnace. As compared to air or flue gases, the heat transfer in the insulating elements, e.g. brickwork or ceramic wool, is increased considerably by $H_2$. Since there are provided two furnaces disposed one above the other, a reduction of the heating efficiency of the entire furnace is observed at the flange points of the two furnaces, apart from the increased construction costs.

It is the object underlying the invention to create a tower furnace as described above, where the desired final temperature of the strip is achieved without exceeding the breaking length of the muffle, and without cooler furnace parts delaying the heating of the strip.

This object is solved by the invention in that an insulated stopper with an electric heating has been inserted at the top of the muffle, whereas below the stopper a preferably gas-heated preheating space is provided.

Since the insulated stopper is much smaller in volume than a furnace without muffle, the furnace will be ready for bright annealing before long with a normal addition of $H_2$, even after an extended interruption of the production. The losses of energy are negligeable due to the slightly decreased temperature of the outer wall of the muffle in the vicinity of the stopper. However, this decrease in temperature at the same time involves an increase in the strength of the material, which in turn provides for an elongation of the muffle, without a risk of exceeding the breaking length of the muffle.

The drawing schematically illustrates an embodiment of a tower furnace in a longitudinal section.

As can be seen, an insulated stopper 1 with an electric heating 2 is inserted at the top into the muffle 3 extending over the entire furnace height. Below the stopper 1 a preheating space 4 is provided, where the muffle is gas-heated from the outside through the clearance 4*a*. Reference numeral 5 designates the outer insulation. As can be seen, the strip 6 provided for the heat treatment passes through the entire furnace length.

What is claimed is:

1. A tower furnace for the heat treatment of metal strips, comprising a muffle extending over the entire furnace height, through which muffle passes the strip, characterized in that an insulated stopper with an electric heater has been inserted at the top into the muffle (3), whereas below the stopper a preheating space is provided.

2. The tower furnace of claim 1 wherein the preheating space is gas-heated.

* * * * *